US008640510B1

(12) United States Patent
Derman

(10) Patent No.: US 8,640,510 B1
(45) Date of Patent: Feb. 4, 2014

(54) INTERFACE MEMBER FOR LOCK SYSTEM AND METHOD

(76) Inventor: Jay S. Derman, Palos Verdes Peninsula, CA (US)

( * ) Notice: Subject to any disclaimer, the term of this patent is extended or adjusted under 35 U.S.C. 154(b) by 155 days.

(21) Appl. No.: 13/296,132

(22) Filed: Nov. 14, 2011

Related U.S. Application Data

(60) Provisional application No. 61/422,178, filed on Dec. 12, 2010.

(51) Int. Cl.
*E05B 69/00* (2006.01)

(52) U.S. Cl.
USPC ..... 70/58; 70/14; 70/18; 70/34; 70/232; 248/551

(58) Field of Classification Search
USPC ..... 70/14, 18, 30, 49, 34, 58, 232; 248/551–553
See application file for complete search history.

(56) References Cited

U.S. PATENT DOCUMENTS

| | | | | |
|---|---|---|---|---|
| 5,992,187 | A | 11/1999 | Derman | |
| 6,081,974 | A | 7/2000 | McDaid | |
| 6,159,025 | A | 12/2000 | Derman | |
| 6,317,936 | B1 | 11/2001 | McDaid | |
| 6,360,405 | B1 | 3/2002 | McDaid | |
| 6,672,115 | B2 | 1/2004 | Wyers | |
| 6,793,081 | B1 | 9/2004 | Derman | |
| 7,165,426 | B2 | 1/2007 | Wyers | |
| 7,225,649 | B2 | 6/2007 | Wyers | |
| 7,775,071 | B2 * | 8/2010 | Agbay | 70/34 |
| 7,997,106 | B2 | 8/2011 | Mahaffey et al. | |
| 8,001,812 | B2 | 8/2011 | Mahaffey et al. | |
| D646,951 | S | 10/2011 | Tsai | |
| 8,042,366 | B2 * | 10/2011 | Mahaffey et al. | 70/58 |
| 8,074,478 | B1 | 12/2011 | Shu | |
| 2007/0220931 | A1 * | 9/2007 | Murray et al. | 70/58 |
| 2010/0180648 | A1 * | 7/2010 | Knox | 70/58 |
| 2010/0186465 | A1 * | 7/2010 | Frantz | 70/58 |
| 2010/0300158 | A1 * | 12/2010 | Andres et al. | 70/58 |
| 2011/0061427 | A1 | 3/2011 | Mahaffey et al. | |
| 2011/0089794 | A1 | 4/2011 | Mahaffey et al. | |
| 2011/0122551 | A1 * | 5/2011 | Hung et al. | 361/679.01 |
| 2012/0125057 | A1 * | 5/2012 | Mahaffey et al. | 70/14 |
| 2012/0312056 | A1 * | 12/2012 | Yu et al. | 70/14 |
| 2013/0133383 | A1 * | 5/2013 | Solomon | 70/34 |

OTHER PUBLICATIONS

Reese Towpower 7006000 Stainless Steel Dual Bent Pin Receiver Lock, http://www.amazon.com, pp. 1-5, accessed Aug. 31, 2011.

* cited by examiner

*Primary Examiner* — Suzanne Barrett
(74) *Attorney, Agent, or Firm* — Aaron P. McGushion

(57) ABSTRACT

A system for securing an interface mechanism within an aperture is disclosed. The system may include an interface mechanism comprising a body portion, extension, anchor, and traveler. The extension may extend from the body portion and have a traveler aperture. The anchor may selectively move through a range of motion with respect to the body portion. The range of motion may include one or more extended positions of the anchor. The traveler may be positioned within the traveler aperture. The traveler selectively moving through a range of motion with respect to the extension. The range of motion of the traveler may contain one or more blocking positions wherein the traveler confines the anchor to one or more extended positions. The system may further include a lock engaging the extension and confining the traveler to one or more blocking positions.

15 Claims, 8 Drawing Sheets

INTERFACE MEMBER FOR LOCK SYSTEM AND METHOD

RELATED APPLICATIONS

This application claims the benefit of U.S. Provisional Patent Application Ser. No. 61/422,178 filed Dec. 12, 2010, which is hereby incorporated by reference.

BACKGROUND

1. The Field of the Invention

This invention relates to security systems and, more particularly, to novel systems and methods for tethering or otherwise securing personal property or other items.

2. The Background Art

As computers, expensive electronic equipment, and other valuable portable articles have become more common, theft of such articles has increased. There are a number of different devices on the market to deter such theft. However, most of these devices do not support engagement with larger apertures or openings in such articles. Accordingly, what is needed is an improved system and method for securing selected articles having larger apertures therein.

BRIEF SUMMARY OF THE INVENTION

In view of the foregoing, in accordance with the invention as embodied and broadly described herein, a method and apparatus are disclosed in one embodiment of the present invention as including a system protecting an item from theft, unauthorized use, or unwanted removal. In selected embodiments, a system may include an item having an interface aperture, an interface mechanism sized and shaped to fit the interface aperture, and a lock selectively engaging the interface mechanism to secure it within the interface aperture. An interface mechanism may include one or more anchors. Once an interface mechanism has been inserted at least partially within an interface aperture, one or more anchors may be deployed or extended. When deployed, an anchor may resist removal of an interface mechanism from a corresponding interface aperture. A lock may cooperate with an interface mechanism in maintaining one or more anchors in a deployed configuration.

In certain embodiments, an interface mechanism may include a body and an extension. An extension may extend from a corresponding body. A lock may selectively (e.g., releasably) engage an extension. An interface mechanism may be configured such that an engagement between an extension and a lock may confine one or more anchors to a deployed or extended position or configuration. Accordingly, whenever a lock engages such an interface mechanism, the interface mechanism may resist removal from or insertion into a corresponding interface aperture.

An extension, body, or both may include a traveler aperture formed therein. A traveler aperture may be sized and shaped to receive a traveler therewithin. A traveler may selectively move through a range of motion within a traveler aperture. In selected embodiments, a range of motion of a traveler may contain one or more blocking positions and one or more non-blocking positions.

A body may include one or more anchor apertures. Each anchor aperture may contain, or partially contain, a corresponding anchor. Each anchor may extend from a corresponding anchor aperture to engage an item. For example, each anchor may extend from a corresponding anchor aperture to engage a back side, shoulder, or surface formed as part of or proximate an interface aperture.

In selected embodiments, a traveler may be configured to translate in the axial direction within a corresponding traveler aperture. For example, a traveler may translate in the axial direction between one or more blocking positions and one or more non-blocking positions. In a blocking position, a traveler may block an anchor from moving out of engagement with an item (e.g., out of engagement with an interface aperture or feature thereof). Accordingly, when a traveler is in a blocking position, an interface mechanism may be secured to (e.g., lock into) a corresponding item.

In a non-blocking position, a traveler may permit an anchor to move within a corresponding anchor aperture. Accordingly, with a traveler in a non-blocking position, an anchor may move out of engagement with an item (e.g., out of engagement with an interface aperture or feature thereof). Accordingly, when a traveler is in a non-blocking position, an interface mechanism may be easily removed from a corresponding item.

In selected embodiments, a traveler may cooperate with an extension to form a composite configuration, profile, or shape adapted to, or compatible with, a lock. Accordingly, a lock may selectively engage an extension, traveler, or both to confine, limit, or control the motion of the traveler.

For example, a traveler and an extension may form, when the traveler occupies certain positions (e.g., a blocking position), a composite configuration, profile, or shape that is compatible with a locking head described in U.S. Pat. No. 7,997,106. Accordingly, in such embodiments, when a lock engages a locking groove of an extension, the lock may contact the traveler and prevent it from moving away from the extension. As a result, a lock may confine a traveler to certain positions (e.g., one or more blocking positions) and, thereby, confine one or more anchors in their respective deployed positions and the interface member within the corresponding interface aperture.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
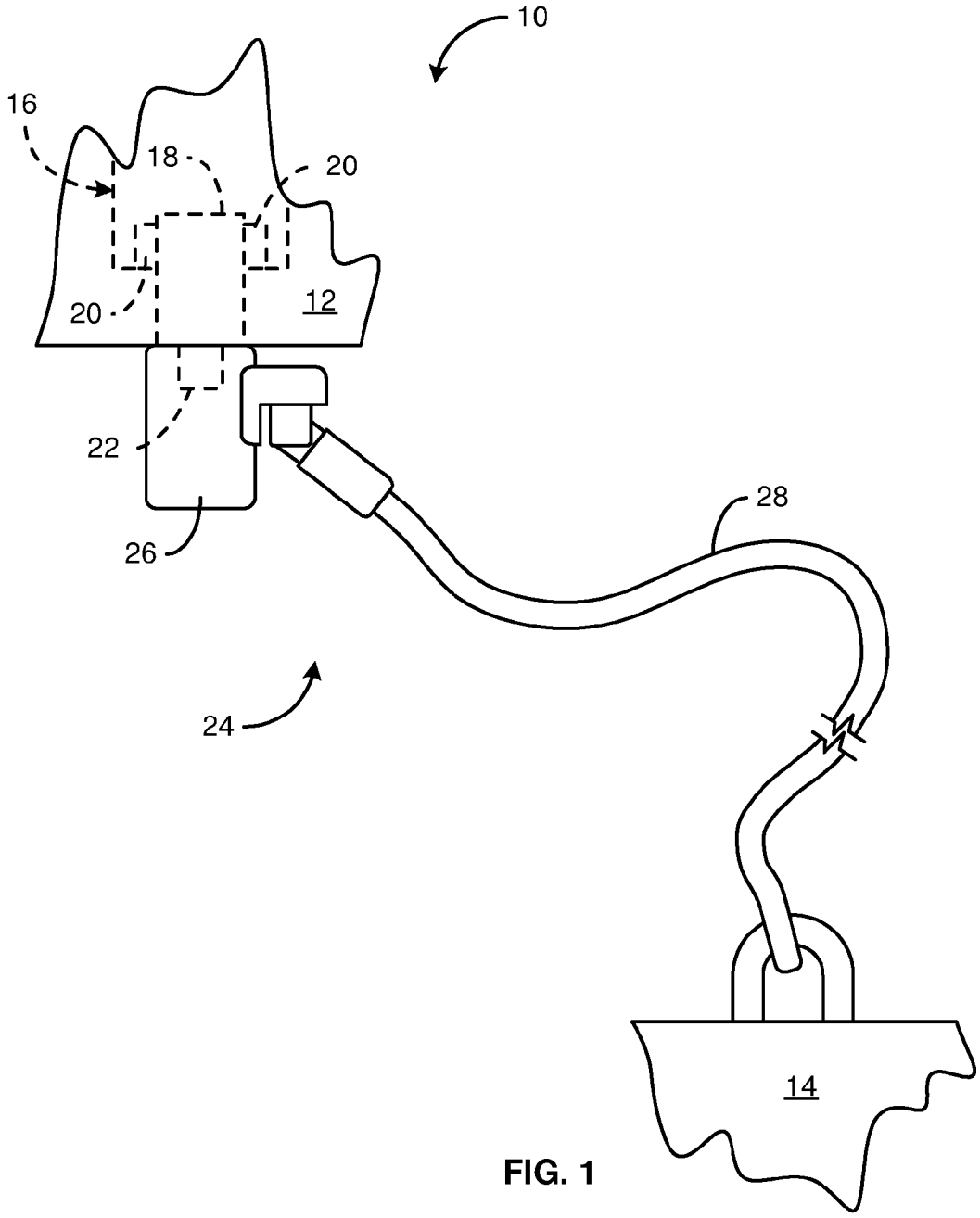
FIG. 1 is a schematic diagram of one embodiment of a system for securing an item in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, a system 10 in accordance with the present invention may protect an item 12 (e.g., valuable portable article, laptop computer, digital music player, camera, container, conduit, or the like) from theft, unwanted removal, unauthorized use, or the like. In selected embodiments, this may be done by blocking access to a particular portion of the item. In other embodiments, it may be done by tethering an item 12 to an anchor 14. An anchor 14 may be an object that is substantially fixed in place (e.g., an embedded post or the like). Alternatively an anchor 14 may be an object sufficiently heavy, bulky, or both to rendering moving the object unpractical or undesirable. For example, an anchor 14 may comprise a desk, table, or the like that may be moved or dismembered, but only with significant effort or with the generation of unwanted attention from surrounding individuals.

In selected embodiments, an item 12 may include an interface aperture 16. An interface mechanism 18 may be sized and shaped to fit an interface aperture 16. An interface mechanism 18 may include one or more anchors 20. Once an interface mechanism 18 has been inserted at least partially within an interface aperture 16, one or more anchors 20 may be deployed or extended. When deployed, an anchor 20 may resist removal of an interface mechanism 18 from a corresponding interface aperture 16.

An interface mechanism 18 may include an extension 22. A lock 24 may selectively (e.g., releasably) engage an extension 22. In selected embodiments, an interface mechanism 18 may be configured such that an engagement between an extension 22 and a lock 24 may confine one or more anchors 20 to a deployed or extended position or configuration. Accordingly, whenever a lock 24 engages such an interface mechanism 18, the interface mechanism 18 may resist removal from or insertion into a corresponding interface aperture 16.

In certain embodiments, a lock 24 may include a locking mechanism 26 and a flexible tether 28. A locking mechanism 26 may be configured to selectively engage an extension 22. A flexible tether 28 may comprise chain, cable, or the like. In selected embodiments, a flexible tether 28 may secure to a locking mechanism 26 and extend therefrom to engage (e.g., loop through or around) an anchor 14.

In selected embodiments, a lock 24 may be configured as or comprise a device disclosed in U.S. Pat. No. 6,081,974 issued Jul. 4, 2000, U.S. Pat. No. 6,317,936 issued Nov. 20, 2001, U.S. Pat. No. 6,360,405 issued Mar. 26, 2002, U.S. Pat. No. 7,997,106 issued Aug. 16, 2011, or U.S. Pat. No. 8,001,812 issued Aug. 23, 2011, each of which are hereby incorporated by reference. For example, a lock 24 may be configured as or comprise a device currently being sold by Kensington Computer Products Group under the CLICKSAFE trademark.

In certain embodiments, a tether 28 may be omitted and a lock 24 may simply comprise a locking mechanism 26. Such a locking mechanism 26 may have any suitable form. For example, in selected embodiments, a locking mechanism 26 may comprise a padlock. Alternatively, a locking mechanism 26 may comprise a locking head or portion thereof as disclosed in U.S. Pat. No. 6,081,974, U.S. Pat. No. 6,317,936, U.S. Pat. No. 6,360,405, U.S. Pat. No. 7,997,106, or U.S. Pat. No. 8,001,812. In such tetherless embodiments, a lock 24 may be useful in confining one or more anchors 20 to a deployed configuration and this alone may provided the desired protection against theft, unwanted removal, unauthorized use, or the like.

The various components of a system 10 in accordance with the present invention may be formed of any suitable materials. Suitable materials may be selected to provide a desired durability, strength, rigidity, toughness, or the like. For example, in selected embodiments, one or more of the components of an interface mechanism 18 may be formed of a polymer material. However, in other embodiments where greater stresses are expected, such components may be formed of a metal or metal alloy.

Figure 2:
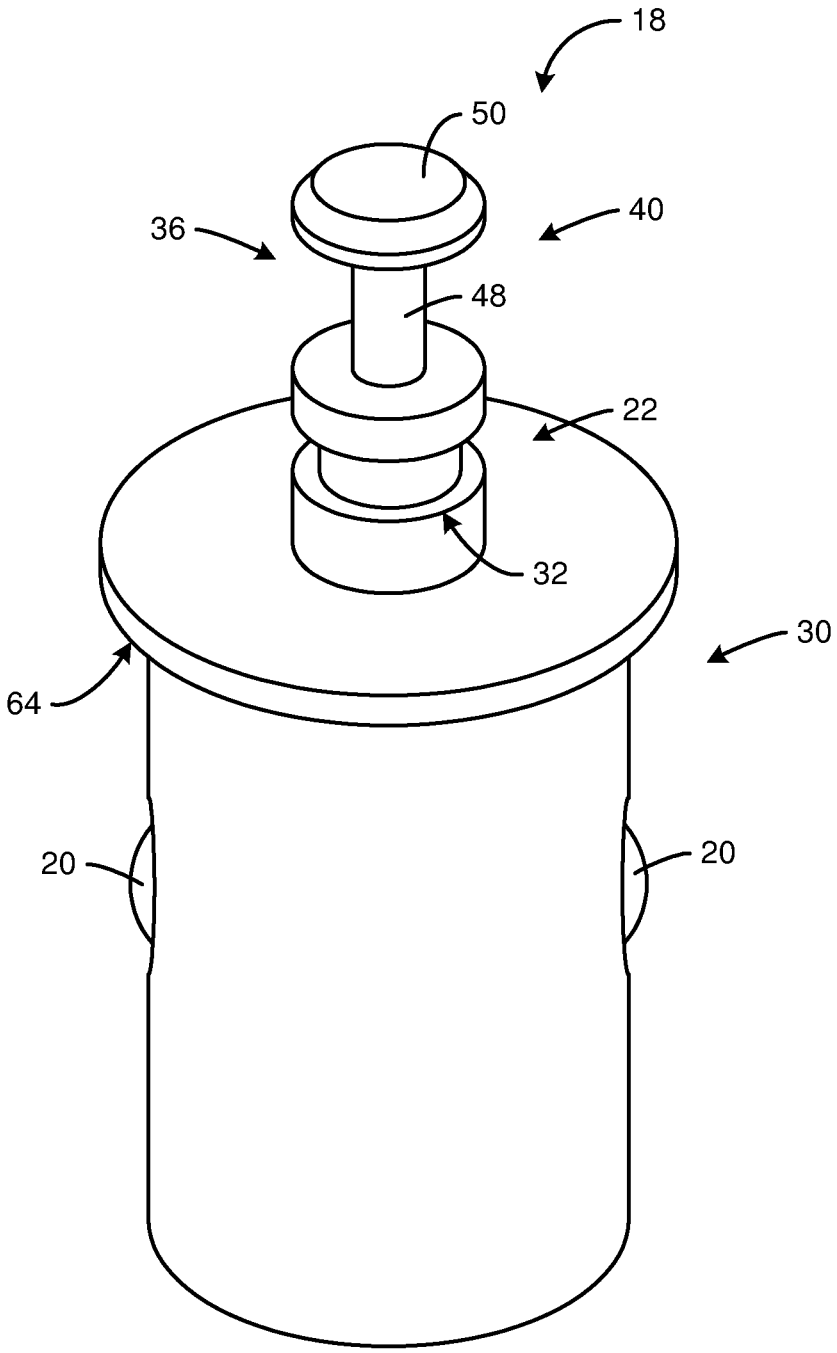
FIG. 2 is a perspective view of one embodiment of an interface mechanism in accordance with the present invention.
Figure 3:
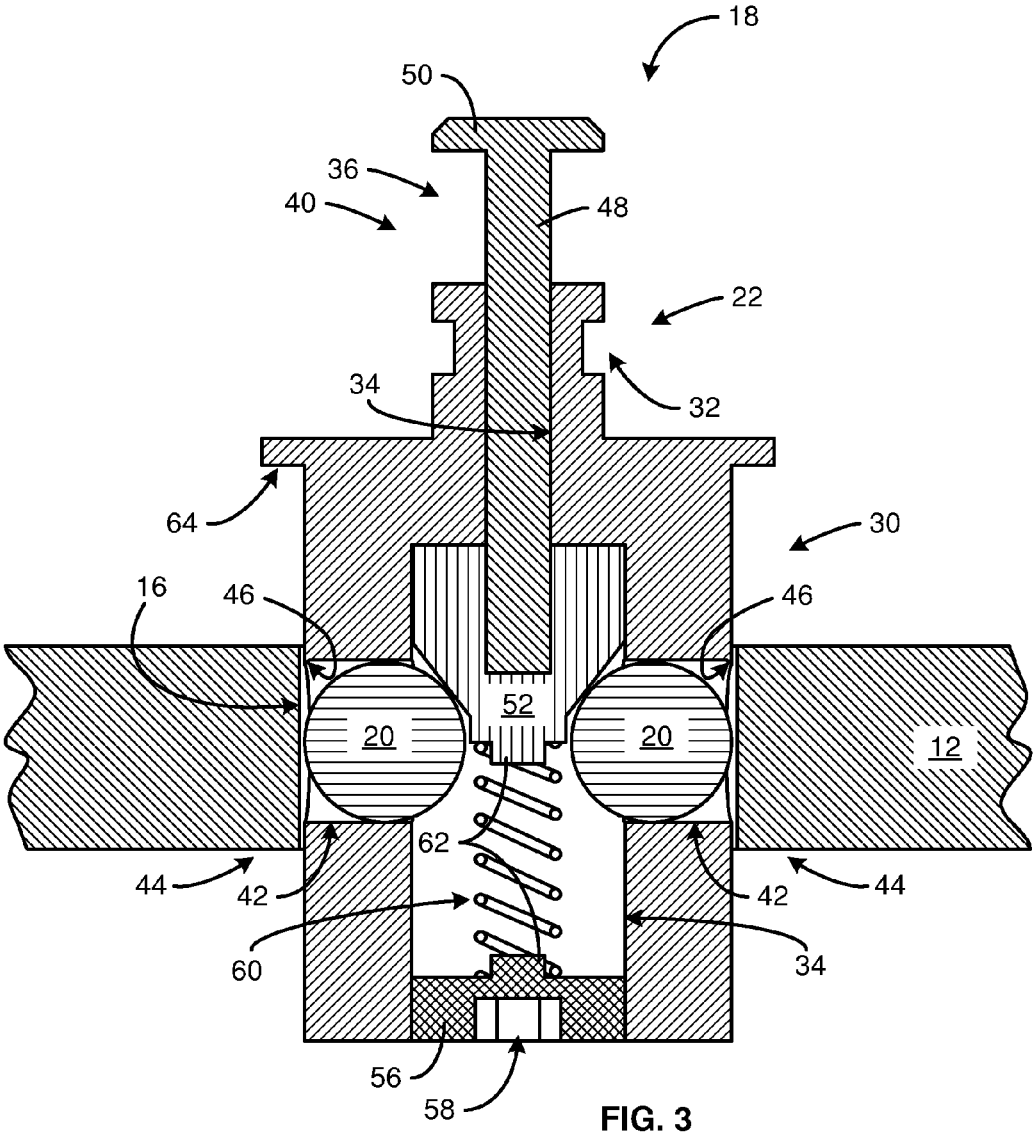
FIG. 3 is a cross-sectional view of the interface mechanism of FIG. 2 being inserted into (or removed from) an interface aperture in accordance with the present invention.
Figure 4:
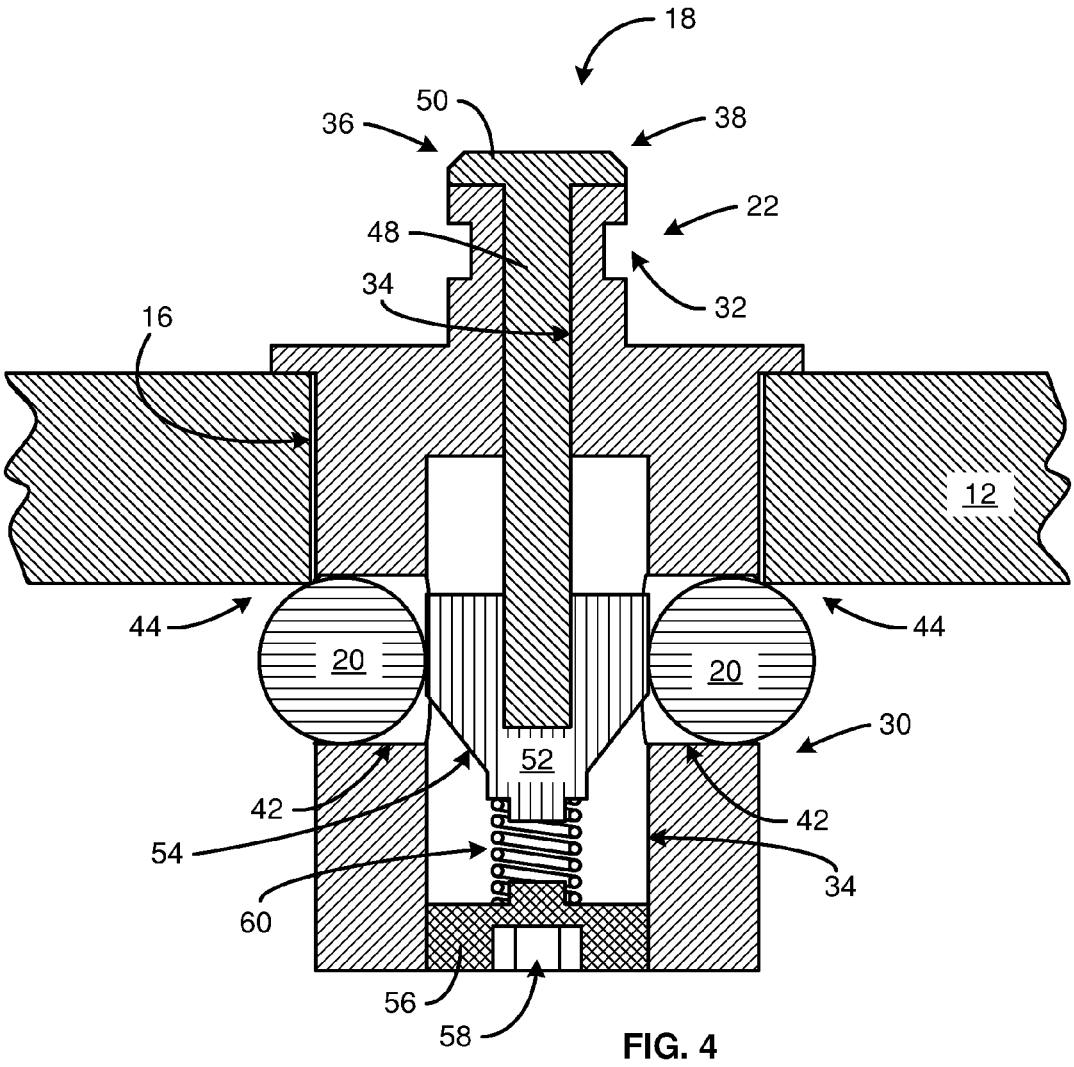
FIG. 4 is a cross-sectional view of the interface mechanism of FIG. 3 inserted within an interface aperture and secured in place by a plurality of anchors in accordance with the present invention.

Referring to FIGS. 2-4, an interface mechanism 18 may have any suitable shape or size. In selected embodiments, an interface mechanism 18 or portion thereof may have a cylindrical shape and define axial, radial, and circumferential directions. For example, an interface mechanism 18 may include a body 30 or body portion 30. A body 30 or portion thereof may have cylindrical shape. Accordingly, a body 30 may be referred to as a cylindrical body 30.

A body 30 may provide a framework for supporting one or more other components of an interface mechanism 18. For example, in selected embodiments, an extension 22 may extend from a body 30. An extension 22 in accordance with the present invention may have any suitable configuration. An extension 22 may connect to, or extend from, a body 30 in any suitable manner. For example, in certain embodiments, an extension 22 may monolithically extend from a body 30. Alternatively, an extension 22 may be secured (e.g., bonded, welded, bolted, threaded, or the like) to a body 30 in an assembly process.

An extension 22 may be configured at least partially as an anchor or attachment mechanism disclosed in U.S. Pat. No. 6,081,974, U.S. Pat. No. 6,317,936, U.S. Pat. No. 6,360,405, U.S. Pat. No. 7,997,106, or U.S. Pat. No. 8,001,812. In other embodiments, an extension 22 may be configured at least partially as an interface mechanism disclosed in U.S. patent application Ser. No. 13/216,076 filed Aug. 23, 2011, which is hereby incorporated by reference.

An extension 22 may include one or more mechanisms or structures enabling an lock 24 to engage therewith. For example, an extension 22 may include an aperture for receiving a shackle. Alternatively, an extension 22 may include a locking groove 32 enabling a lock 24 to selectively grip thereon. In certain embodiments, a locking groove 32 may extend circumferentially about an extension 22. Such a locking groove 32 may enable a lock 24 to pivot about the corresponding extension 22, while maintaining a secure engagement therewith.

An extension 22, body 30, or both may include a traveler aperture 34 formed therein. A traveler aperture 34 may be sized and shaped to receive a traveler 36 therewithin. A traveler 36 may selectively move through a range of motion within a traveler aperture 34. In selected embodiments, a range of motion of a traveler 36 may include a blocking portion and a non-blocking portion. A blocking portion may include one or more blocking positions 38 of a traveler 36. A non-blocking portion may include one or more non-blocking positions 40 of a traveler 36.

A body 30 may include one or more anchor apertures 42. Each anchor aperture 42 may contain, or partially contain, a corresponding anchor 20. Each anchor 20 may extend from a corresponding anchor aperture 42 to engage an item 12. For example, each anchor 20 may extend from a corresponding anchor aperture 42 to engage a back side 44, shoulder 44, or surface 44 formed as part of or proximate an interface aperture 16.

An anchor 20 may be maintained within an anchor aperture 42 in any suitable manner. In selected embodiments, one or more constrictions 46 may maintain an anchor 20 in place. One or more constrictions 46 may be formed in an initial machining process, casting process, molding process, or the like. Alternatively, or in addition thereto, one or more constrictions 46 may be formed or installed in an assembly process.

For example, in selected embodiments, after an anchor 20 has been placed within a corresponding anchor aperture 42, a locking ring may be installed to form a constriction 46 preventing inadvertent removal of the anchor 20 from the anchor aperture 42. Alternatively, after an anchor 20 has been placed within an anchor aperture 42, a portion (e.g., an opening) of the anchor aperture 42 may be swaged or otherwise deformed to form a constriction 46 preventing inadvertent removal of the anchor 20.

An interface mechanism 18 may include a plurality of anchors 20 and corresponding anchor apertures 42. In selected embodiments, the number of anchors 20 may be selected to distribute the loads applied thereby to a corresponding interface aperture 16. Such distribution may lower the stress imposed on the interface mechanism 18, interface aperture 16, anchors 20, anchor apertures 42, traveler 36, and the like. It may also balance such loading. In selected embodiments, two or three anchors 20, each contained within a corresponding anchor aperture 42, uniformly distributed in a circumferential direction about an body 30 may be sufficient.

An anchor 20 in accordance with the present invention may be biased toward a particular position or configuration. For example, an anchor 20 may be biased (e.g., by a spring, magnet, or the like) radially inward within a corresponding anchor aperture 42. Alternatively, an anchor 20 may be biased radially outward within a corresponding anchor aperture 42. In still other embodiments, an anchor 20 may be unbiased and, when not confined by a traveler 36, travel relatively freely within a corresponding anchor aperture 42.

An anchor 20 in accordance with the present invention may have any suitable shape. For example, an anchor 20 may be spherical. Accordingly, in selected embodiments, one or more anchors 20 may comprise metal balls such as those for ball bearings.

In selected embodiments, a traveler 36 may be configured to translate in the axial direction within a corresponding traveler aperture 34. For example, a traveler 36 may translate in the axial direction between one or more blocking positions 38 and one or more non-blocking positions 40. In a blocking position 38, a traveler 36 may block an anchor 20 from moving out of engagement with an item 12 (e.g., out of engagement with an interface aperture 16 or feature 44 thereof). Accordingly, when a traveler 36 is in a blocking position 38, an interface mechanism 18 may be secured to (e.g., locked into) a corresponding item 12.

In a non-blocking position 40, a traveler 36 may permit an anchor 20 to move within a corresponding anchor aperture 42. Accordingly, with a traveler 36 in a non-blocking position 40, an anchor 20 may move out of engagement with an item 12 (e.g., out of engagement with an interface aperture 16 or feature 44 thereof). Accordingly, when a traveler 36 is in a non-blocking position 40, an interface mechanism 18 may be easily removed from a corresponding item 12.

A traveler 36 in accordance with the present invention may have any suitable configuration or shape. In selected embodiments, a traveler 36 may comprise a sphere. Alternatively, or in addition thereto, a traveler 36 may include a shaft 48. A shaft 48 may communicate motion from one end thereof to the other. For example, one end of a shaft 48 may be positioned proximate an extension 22. An opposite end of the shaft 48 may be positioned within an interior of a body 30 (i.e., within a traveler aperture 34 of a body 30). Accordingly, a shaft 48 may communicate motion imposed thereon at the extension 22 to the interior of a body 30 or vice versa.

A traveler 36 may include a head 50. A head 50 may be connected to one end of a shaft 48. A head 50 may comprise a monolithic extension of a shaft 48. For example, a head 50 and shaft 48 may collectively comprise a screw, bolt, or the like. In other embodiments, a head 50 may be a separate unit positioned adjacent one end of a shaft 48. In still other embodiments, a head 50 be omitted and one end of a shaft 48 may perform the function thereof.

In selected embodiments, a head 50 of a traveler 36 may cooperate with an extension 22 to form a composite configuration, profile, or shape adapted to, or compatible with, a locking mechanism 26. Accordingly, a locking mechanism 26 may selectively engage an extension 22, traveler 36, or both to confine, limit, or control the motion of the traveler 36.

For example, a head 50 and an extension 22 may form, when the traveler 36 occupies certain positions (e.g., a blocking position 38), a composite configuration, profile, or shape that is compatible with a locking head described in U.S. Pat. No. 7,997,106. Accordingly, in such embodiments, when a locking mechanism 26 engages a locking groove 32 of an extension 22, the locking mechanism 26 may contact a head 50 and prevent it from moving away from the extension 22. As a result, a locking mechanism 26 may confine a traveler 36 to certain positions (e.g., one or more blocking positions 38).

In selected embodiments, a traveler 36 may include a blocking member 52. A blocking member 52 may provide an interface between one or more anchors 20 and the rest of a traveler 36. A blocking member 52 may be connected to one end of a shaft 48 (e.g., an end of the shaft 48 that is opposite a head 50). A blocking member 52 may comprise a monolithic extension of a shaft 48. In other embodiments, a blocking member 52 may threadedly or otherwise engage an end of a shaft 48. In still other embodiments, blocking member 52 may be a separate unit positioned adjacent one end of a shaft 48. Alternatively, a blocking member 52 may be omitted and one end of a shaft 48 may perform the function thereof.

A blocking member 52 may have any suitable shape. In selected embodiments, a blocking member 52 may have a cylindrical shape. In other embodiments, a blocking member 52 may be shaped to facilitate manipulation of one or more anchors 20. For example, a blocking member 52 may have one or more angled or conical surfaces 54 that gradually ramp or direct one or more anchors 20 into particular positions (e.g., a deployed or extended position).

In certain embodiments, an interface mechanism 18 may include an end cap 56. An end cap 56 may close one end of a traveler aperture 34 formed within a body 30 of an interface mechanism 18. Accordingly, in selected embodiments, an end cap 56 may prevent a traveler 36 from inadvertently exiting a traveler aperture 34.

An end cap 56 may secure to a body 30 in any suitable manner. For example, in selected embodiments, an end cap 56 may secure to a body 30 with a friction fit or with a detent mechanism. Alternatively, an end cap 56 may secure to a body via a mechanical connection such as a threaded engagement or the like. Accordingly, an end cap 56 may include an aperture 58 for receiving a driver (e.g., screw driver, hexagonal driver, or the like).

An interface mechanism 18 may include one or more biasing members 60. A biasing member 60 may bias a traveler 36 to certain positions. For example, a biasing member 60 may bias a traveler 36 toward a blocking position 38. Alternatively, a biasing member 60 may bias a traveler 36 toward a non-blocking position 40. In selected embodiments, a biasing member 60 may comprise a spring (e.g., coil spring).

A biasing member 60 may be located and held in place in any suitable manner. In selected embodiments, a biasing member 60 may bias a traveler 36 toward a non-blocking position 40. To do so, the biasing member 60 may be positioned between a traveler 36 and an end cap 56. Accordingly, to transition from a non-blocking position 40 to a blocking position 38, the traveler 36 may compress the biasing member 60 against the end cap 56. One or more of the traveler 36 and end cap 56 may include structures 62 (e.g., apertures 62, extensions 62, or the like) configured to maintain a biasing member 60 in its proper location.

In selected embodiments, an interface mechanism 18 may include a flange 64 or shoulder 64. A flange 64 may have any suitable shape or configuration. A flange 64 may assisting in registering an interface mechanism 18 within a corresponding interface aperture 16. Additionally, a flange 64 may cooperate with one or more anchors 20 to engage or grip an item 12. For example, a flange 64 and anchor 20 may grip, confine, or otherwise secure a portion of an item 12 therebetween.

Figure 5:
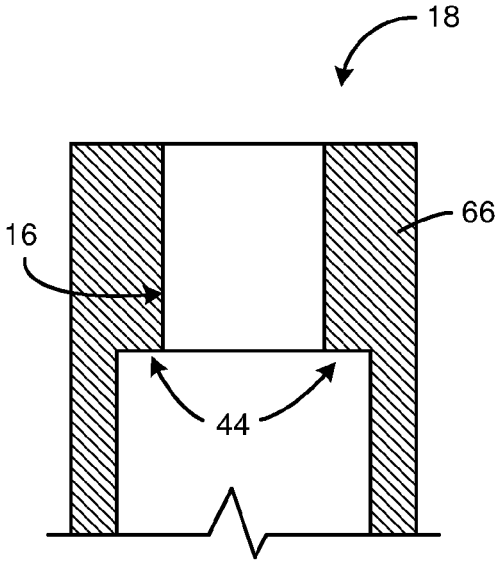
FIG. 5 is a cross-sectional view of one embodiment of an interface aperture in accordance with the present invention.
Figure 6:
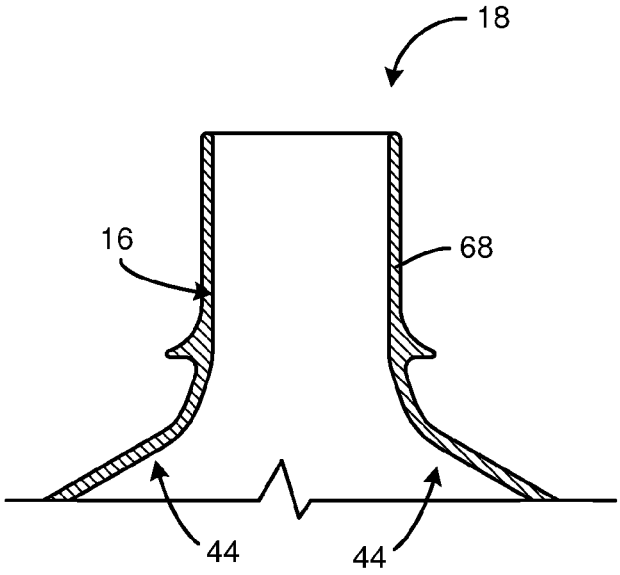
FIG. 6 is a cross-sectional view of another embodiment of an interface aperture in accordance with the present invention.

Referring to FIGS. 5 and 6, an interface mechanism 18 in accordance with the present invention may be adapted to engage items of various sizes, configurations, and uses. In selected embodiments, an interface mechanism 18 may be adapted to engage, block, or both engage and block an aperture 16 forming part of a conduit. For example, an aperture 16 may comprise an interior conduit of a pipe 66, faucet 66, or the like. Alternatively, an aperture 16 may comprising the opening of a bottle 68, container 68, or the like. In either case, the aperture 16 may include a surface 44, shoulder 44, flare 44, or the like against or upon which one or more anchors 20 may act. Accordingly, an interface mechanism 18 of a corresponding size and shape may be inserted and locked within the aperture 16.

In selected embodiments, an interface mechanism 18 may include a seal. For example, an interface member 18 may include a rubber gasket or the like. A seal may enable an interface mechanism 18 to resist or block the flow of fluids through an interface aperture 16. In certain embodiments, a seal may be positioned adjacent a flange 64 of an interface mechanism 18. Accordingly, deployment of one or more anchors 20 may cause a seal to be seated between a flange 64 and a rim or border of an interface aperture 16.

Figure 7:
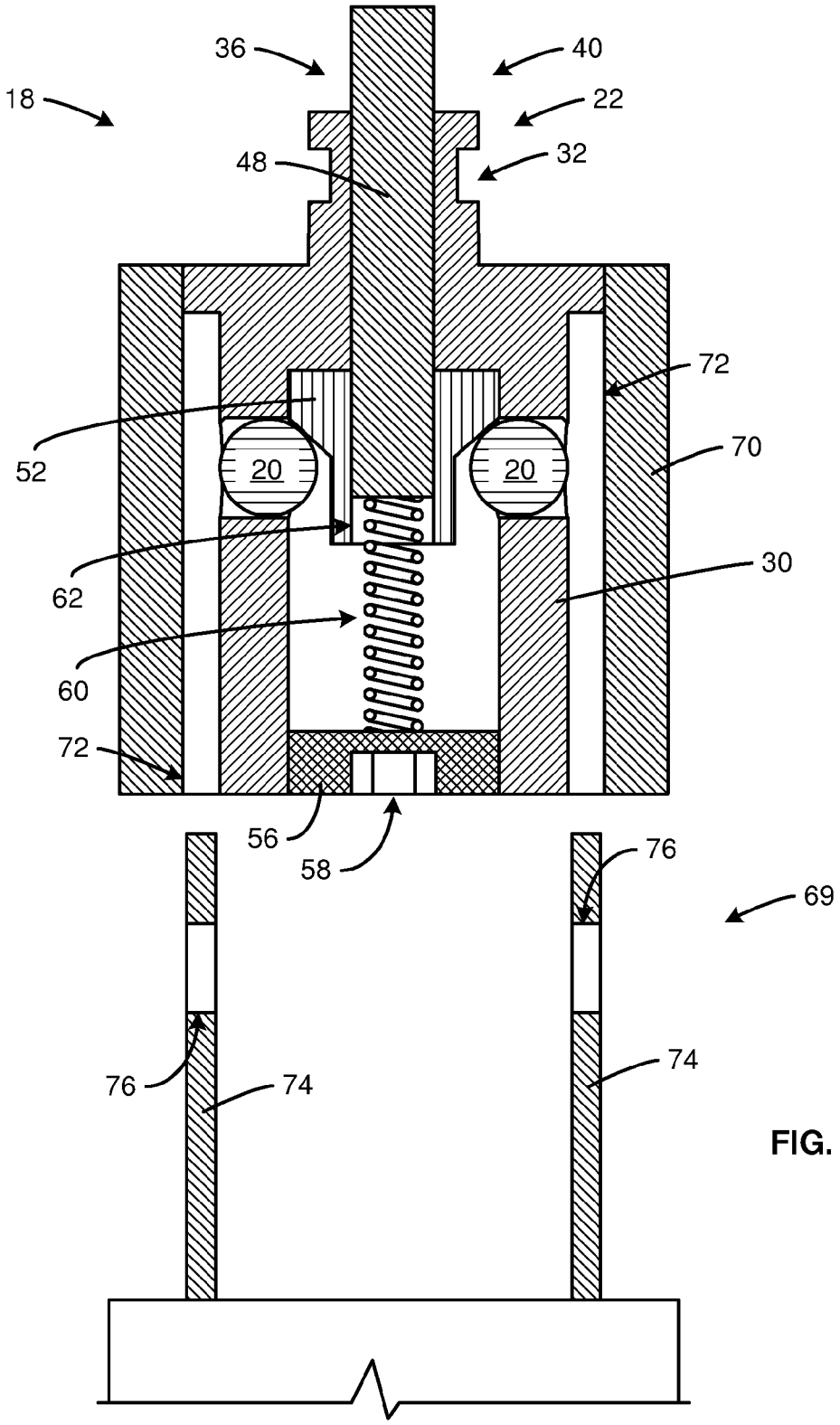
FIG. 7 is a cross-sectional view of an alternative embodiment of an interface mechanism set to engage an electrical plug in accordance with the present invention.
Figure 8:
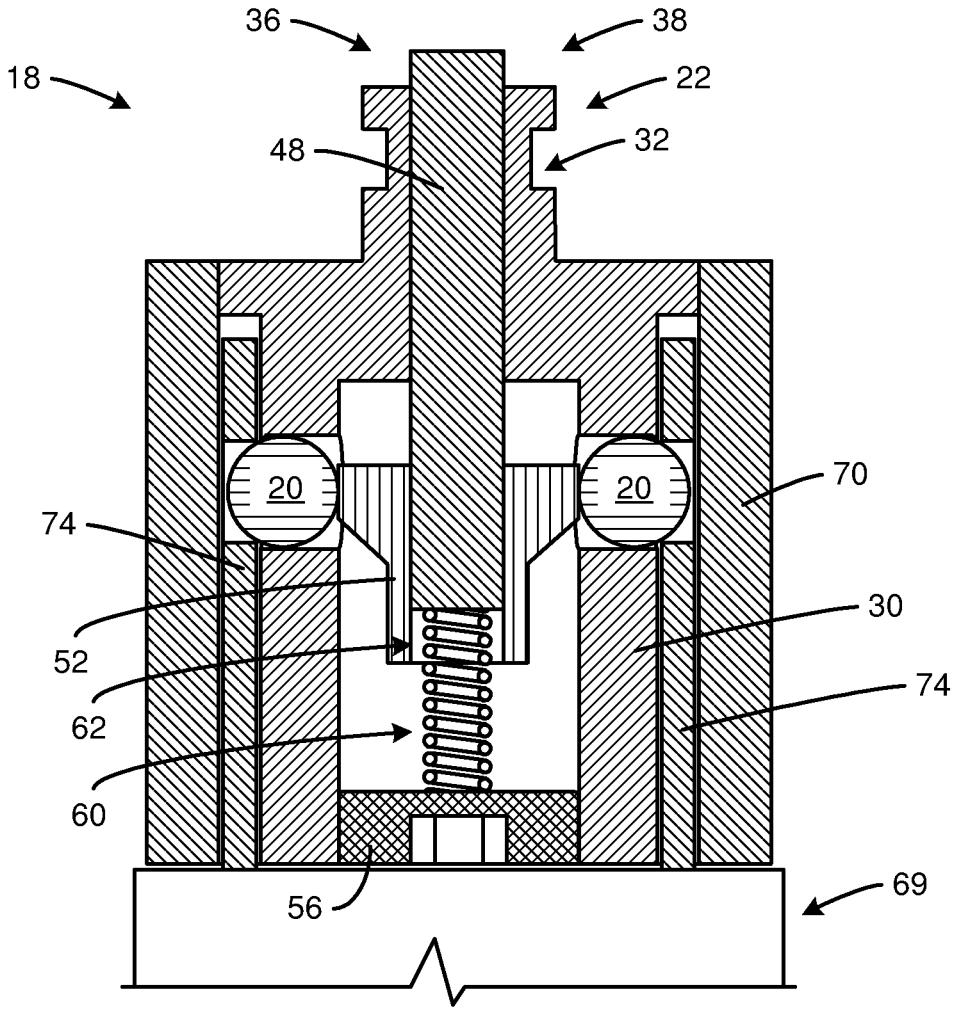
FIG. 8 is a cross-sectional view of the interface mechanism of FIG. 7 engaging an electrical plug in accordance with the present invention.

Referring to FIGS. 7 and 8, an interface mechanism 18 in accordance with the present invention may be used to occupy an item 12 or otherwise prevent its being used in a particular manner. For example, in selected embodiments, an interface mechanism 18 may be used to occupy or secure an electrical plug 69 to prevent the plug 69 from being inserted within a power outlet.

In such embodiments, an interface mechanism 18 may include a housing 70 or outer shell 70. The housing 70 may cooperate with a body 30 to form one or more apertures 72 for receiving one or more prongs 74 of a plug 69 therewithin. Such prongs 74 may have apertures 76 formed therein. Accordingly, once an interface mechanism 18 has been applied to a plug 69 (e.g., once one or more prongs 74 of a plug 69 have been inserted within corresponding apertures 72), one or more anchors 20 may be deployed or extended to engage one or more apertures 76 in the prongs 74. A traveler 36 may confine the one or more anchors 20 to the deployed position and a locking mechanism 26 may confine the traveler 36 to a blocking position 38. Accordingly, the prongs 74 may be locked within an interface mechanism 18 and rendered inaccessible for use and securely coupled to a lock 24 (which lock 24 may be connected to an anchor 14).

In certain embodiments, a plug 69 may include one or more prongs 74 that do not have apertures 76. For example, conventional plugs 69 often include a third, ground pong that is cylindrical in shape and does not include an aperture extending transversely therethrough. Such prongs 74 may be accommodated in any suitable manner. In selected embodiments, an interface mechanism 18 may be shaped or sized to avoid such prongs 74. Alternatively, an interface mechanism 18 may admit such prongs 74 within corresponding apertures 76, but not attempt to anchor them.

Figure 9:
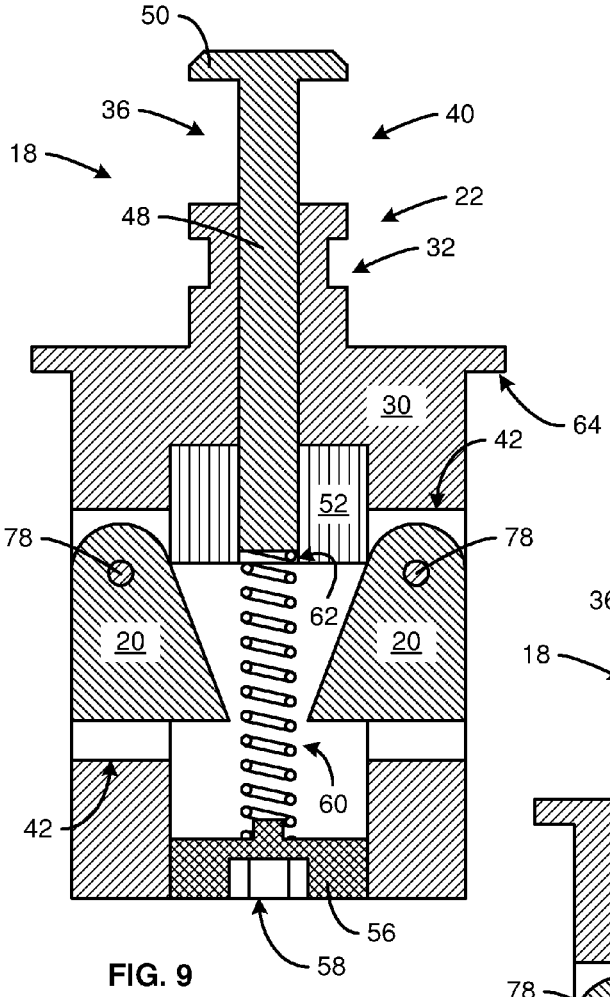
FIG. 9 is a perspective view of another alternative embodiment of an interface mechanism in accordance with the present invention with the anchors in an non-deployed or retracted position.
Figure 10:
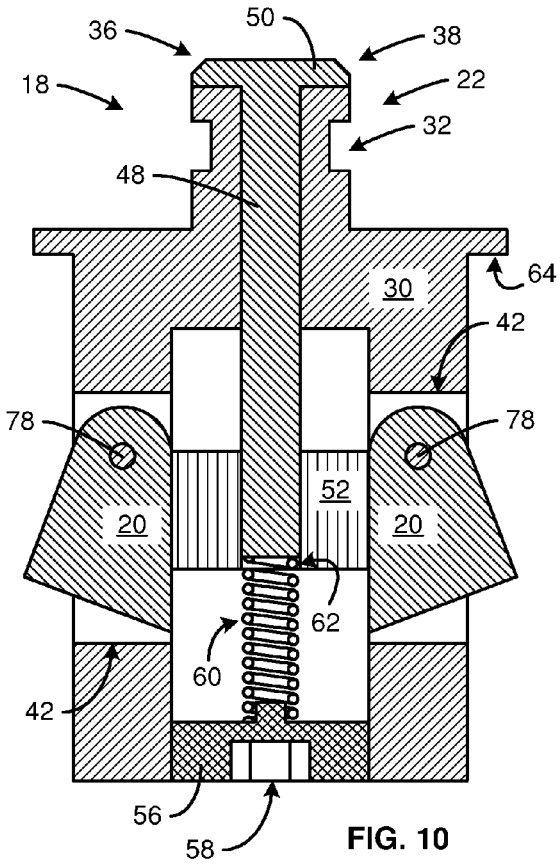
FIG. 10 is a cross-sectional view of the interface mechanism of FIG. 9 in accordance with the present invention with the anchors held in a deployed or extended position by a traveler.

Referring to FIGS. 9 and 10, an anchor 20 may move with respect to the rest of an interface mechanism 18 in any suitable manner. For example, an anchor 20 (e.g., a spherical anchor 20) may roll within an anchor aperture 42, translate within an anchor aperture 42, or both as it moves between one or more deployed and non-deployed positions. Alternatively, an anchor 20 may be configured to pivot with respect to the rest of an interface mechanism 18.

For example, in selected embodiments, one or more anchors 20 may be secured within respective anchor apertures 42 (e.g., anchor slots 42) by respective pivots 78. Accordingly, as a traveler 36 moves from a non-blocking position 40 to a blocking position 38, one or more anchors 20 may pivot from a non-deployed (e.g., retracted) position to a deployed position.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An interface mechanism comprising:

a body portion having an exterior, an interior cavity, a top wall, a side wall, and an anchor aperture formed through the side wall communicating between the exterior and the interior cavity;

an extension with a distal end, the extension extending from the top wall of the body portion and having a traveler aperture communicating between the distal end and the interior cavity;

a first anchor selectively moving through a range of motion through the anchor aperture with respect to the body portion, the range of motion of the first anchor comprising one or more extended positions of the first anchor wherein the first anchor extends from the body portion through the anchor aperture; and a traveler positioned within the traveler aperture, the traveler selectively moving through a range of motion with respect to the extension, the range of motion of the traveler containing one or more blocking positions wherein the traveler confines the first anchor to the one or more extended positions, the anchor being free to retract within the anchor aperture when the traveler is in a non-blocking position;

wherein the extension is configured to receive a lock selectively engaged to the extension and securing the traveler to the one or more blocking positions by preventing substantial movement of the traveler.

2. The interface mechanism of claim 1, wherein the extension is cylindrical in shape and defines axial, radial, and circumferential directions.

3. The interface mechanism of claim 2, wherein the extension comprises a locking groove extending circumferentially thereabout.

4. The interface mechanism of claim 3, wherein the lock selectively engages the locking groove.

5. The interface mechanism of claim 4, wherein the aperture extends through the extension in the axial direction.

6. The interface mechanism of claim 5, further comprising a second anchor selectively moving through a range of motion through a second anchor aperture with respect to the body portion, the second anchor aperture being formed through the side wall and communicating between the exterior and the interior cavity, the range of motion of the second anchor comprising one or more extended positions of the second anchor wherein the second anchor extends from the body portion through the second anchor aperture.

7. The interface mechanism of claim 6, wherein the traveler in the one or more blocking positions confines the second anchor to the one or more extended positions.

8. The interface mechanism of claim 1, wherein the body portion is cylindrical in shape.

9. The interface mechanism of claim 1, wherein the anchor is spherical in shape.

10. The interface mechanism of claim 1, wherein a portion of the body is configured to be inserted into an interface aperture of an item.

11. The interface mechanism of claim 10, wherein the anchor, confined to the one or more extended positions, resists removal of the portion of the body from the interface aperture.

12. The interface mechanism of claim 11, wherein a flexible tether ties the lock to an anchoring point.

13. An interface mechanism comprising:

a cylindrical body with an interior cavity, an outer wall, and an extension extending axially from a first end of the body, a traveler aperture is formed axially through the extension to the interior cavity, and an anchor aperture is formed axially from the outer wall to the interior cavity;

a spherical anchor normally free to travel within the anchor aperture when in a unblocked configuration, and the spherical anchor restricted to extend out of the anchor aperture and protrude from the outer wall in a blocked configuration;

a traveler configured to move axially within the traveler aperture, the traveler having a blocking portion that moves with the traveler and is located within the interior cavity;

wherein in the unblocked configuration the traveler and the blocking portion are positioned to permit the spherical anchor to retract within the anchor aperture, and in the blocked configuration the traveler and the blocking portion are positioned to push the spherical anchor to protrude from the outer wall;

and wherein the extension is configured to receive a lock selectively engaged to the extension and securing the traveler position to the blocked configuration.

14. The interface mechanism of claim 13 wherein a spring axially biases the traveler to the unblocked position.

15. The interface mechanism of claim 13 further comprising a flange, wherein a portion of the body is configured to be inserted into an interface aperture of an item, with the flange limiting the insertion and the spherical anchor preventing removal of the portion of the body from the interface aperture when in the blocked configuration.

* * * * *